US006388643B1

(12) United States Patent
Huang

(10) Patent No.: US 6,388,643 B1
(45) Date of Patent: May 14, 2002

(54) METHOD OF DRIVING A PLASMA DISPLAY

(75) Inventor: Jih Fon Huang, Chu-Bei (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/383,818

(22) Filed: Aug. 26, 1999

(30) Foreign Application Priority Data

Aug. 26, 1998 (TW) ..... 87114117 A

(51) Int. Cl.[7] ..... G09G 3/28

(52) U.S. Cl. ..... 345/60; 345/55; 345/63; 345/68

(58) Field of Search ..... 345/60, 55, 76, 345/89, 63, 68

(56) References Cited

U.S. PATENT DOCUMENTS 5,818,419 A * 10/1998 Tajima et al. ..... 345/147
5,914,563 A * 6/1999 Lee et al. ..... 313/585
5,959,619 A * 9/1999 Kameyama et al. ..... 345/204
6,072,447 A * 6/2000 Noborio ..... 345/60
6,107,978 A * 8/2000 Nagaoka et al. ..... 345/60
6,160,529 A * 12/2000 Asao et al. ..... 345/60
6,169,527 B1 * 1/2001 Kanazana et al. ..... 345/60
6,172,465 B1 * 1/2001 Huang ..... 315/169.3

* cited by examiner

*Primary Examiner*—Mark Zimmerman
*Assistant Examiner*—Mackly Monestime
(74) *Attorney, Agent, or Firm*—Ladas & Parry

(57) ABSTRACT

A method of driving a plasma display. Generally speaking, one frame comprises several sub-frames, each of which is displayed by one reset operation, one scan operation and a sustain operation in this driving method, the screen of the plasma display is first divided into a plurality of sub-regions. Then the controller sequentially performs the reset operation, the scanning operation and the sustain operation on these sub-regions. In the driving process, the sustain operation on one of the sub-regions is synchronized with the scan operation of another one of the sub-regions that is subsequently processed, thereby increasing the period of the sustain operation. In addition, the reset operation on one of the sub-regions does not overlap the scan operations and the sustain operations on others sub-regions for preventing signal interference.

16 Claims, 5 Drawing Sheets

METHOD OF DRIVING A PLASMA DISPLAY

BACKGROUND OF THE INVENTION

1. Field of the Invention

The present invention generally relates to a driving technique. More specifically, the present invention relates to a method of driving a plasma display, in which the plasma screen is divided into two or more regions and the scan operation and the sustain operation are coincident in timing, thereby increasing the working period of the sustain operation and improving the brightness level of the plasma display.

2. Description of the Related Art

In the current driving technique for plasma displays, the whole screen of a plasma display is driven by three kinds of operations, including the reset operation, the scan operation and the sustain operation. In detail, a frame-display operation in the plasma display includes several sub-frame operations. The number of the sub-frames in one frame depends on the bit-depth of gray scales nor example, one frame in a plasma display with 256 gray scales, which means a bit-depth of 8 bits, includes eight sub-frames. Each sub-frame operation involves one reset operation, one scan operation and one sustain operation.

Using the conventional driving technique, the scan operation usually wastes a lot of operating time in the predefined frame period. For a plasma display with 256 gray scales and a resolution of 800×600, suppose that each of the reset operation requires 150 $\mu$s and the time for scanning a scanning line is about 3 $\mu$s. Then the total time for the reset operations and the scan operations in one frame-display operation is about (150+3×600)×8=15.6 ms, which exceeds 90% of the frame period (16.7 ms) specified in NTSC standard. Therefore, the remaining time for the sustain operation is inadequate to produce sufficient brightness on the plasma display. In addition, such driving technique cannot be applied to plasma displays with higher resolutions, such as 1280×1024.

FIG. 1 (Prior Art) is a top view of a three-electrode surface discharge plasma display with a resolution of 800×600. Numeral 1 represents a plasma display panel. Numeral 2 represents X-electrodes. Numeral 3 (including $\mathbf{3}_1$~$\mathbf{3}_{600}$) represents Y-electrodes. Numeral 4 (including $\mathbf{4}_1$~$\mathbf{4}_{800}$) represents data electrodes. Numeral 5 represents picture pixels, which are defined by X-electrodes 2, Y-electrodes 3 and data electrodes 4. It is noted that the total number of the picture pixels is 800×600. Numeral 6 represents ribs that are used to separate picture pixels 5. $L_1$~$L_{600}$ represent display scanning lines.

FIG. 2 (Prior Art) is a schematic cross-sectional view of picture pixel 5 in the plasma display. In FIG. 2, numerals 8 and 9 represent a rear glass substrate and a front glass substrate, respectively. Numeral 10 represents an insulation layer that covers X-electrode 2 and Y-electrodes 3. Numeral 11 represents a passivation layer, for example, made of MgO. Numeral 12 represents a fluorescent layer. Numeral 13 represents discharge space.

FIG. 3 (Prior Art) is a circuit diagram showing the plasma screen and its peripheral circuitry. Numeral 14 represents an X driver circuit for providing writing pulses and sustaining discharge pulses to X-electrode 2. Numeral 15 represents Y driver ICs for providing addressing pulses to Y-electrodes $\mathbf{3}_1$~$\mathbf{3}_{600}$. Numeral 16 represents an Y driver circuit for providing addressing pulses to Y driver ICs 15. Numeral 17 represents data driver ICs for providing data pulses to data electrodes $\mathbf{4}_1$~$\mathbf{4}_{800}$. Numeral 18 represents a control circuit for controlling X driver circuit 14, Y driver ICs 15, Y driver circuit 16 and data driver ICs 17.

FIG. 4 (Prior Art) is a schematic diagram for illustrating a full frame-display operation using the conventional driving technique. As shown in FIG. 4, one frame-display operation consists of eight sub-frame operations SF1~SF8. Each sub-frame operation includes a reset step, a scan step and a sustain step. The working periods of the reset operations or the scan operations in these sub-frame operations are the same. In other words, Tw1=Tw2=. . . =Tw8 and Ta1=Ta2=. . . =Ta8. The working periods for the sustain operations in one frame-display operation are assigned at a fixed ratio, thereby exhibiting various gray scales. In the case of 256 gray scales, the ratio of the working periods of the eight sustain steps can be assigned to 1:2:4:8:16:32:64:128.

In addition, the working period for the scan operation is proportional to the number of the scanning lines. Therefore, when the resolution increases, the ratio of the scan operation occupied in the whole frame-display operation also increases. This may cause two problems. First, since the usable time for each frame-display operation is fixed, extending the period of the scan operation may result in the shortening of the sustain operation. However, the brightness level of the plasma display depends on the period of the sustain operation. Therefore, the plasma display using the conventional driving technique suffers the drawback of insufficient brightness. Second, since the period of the scan operation is restricted by the usable time dedicated to the frame-display operation, this conventional driving technique cannot be directly applied in the plasma display with higher resolutions.

SUMMARY OF THE INVENTION

Therefore, an object of the present invention is to provide a method of driving a plasma display for increasing the period of the sustain operations, thereby improving the brightness level and the resolution limitation of the plasma display.

The present invention achieves the above-indicated objects by providing a method of driving a plasma display, in which a frame is displayed by sequentially performing a reset operation, a scanning operation and a sustain operation. First, the screen of the plasma display is divided into a plurality of non-overlapped sub-regions. These sub-regions can be individually driven for displaying. Then these sub-regions are sequentially driven by the reset operation, the scanning operation and the sustain operation. During the driving process, the sustain operation on one of the sub-regions is synchronized with the scan operation of another one of the sub-regions that is subsequently processed. In addition, the reset operation on one of the sub-regions does not overlap the scan operations and the sustain operations on others sub-regions, which means that any operations on these sub-regions cannot be performed during the process of the reset operation.

For example, the screen of the plasma display can be divided into a first sub-region and a second sub-region. When a reset operation is performed on the first (second) sub-region of the screen of the plasma display, the controller must halt driving the second (first) sub-region for preventing signal interference between these sub-regions. When a scan operation is performed on the first (second) sub-region, the controller can perform the sustain operation on the second (first) sub-region. Therefore, the working period of the sustain operation does not need to occupy extra time and can be maximally extended to be the working period of the scan operation, thereby improving the brightness level of the plasma display and overcoming the resolution limitation.

Further features and advantages of the present invention, as well as the structure and operation of various embodiments of the present invention, are described in detail below with respect to the accompanying drawings.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE PREFERRED EMBODIMENTS

In the present invention, the brightness level of the plasma display is upgraded by overlapping the working periods of the scan operation and the sustain operation in different and non-overlapped sub-regions of the screen of the plasma display for elongating the sustain operations.

In the driving method disclosed in the present invention, the screen of the plasma display is first divided into two or more sub-regions. Then these sub-regions are sequentially and individually reset and scanned. The sustain operation pertaining to one sub-region is performed at the beginning of the scan operation on the next processed sub-region. It is noted that the reset operation on any sub-region should not be coincident with the scan operations or the sustain operations on the other sub-regions for preventing signal interference between these sub-regions. In the following, two embodiments for illustrating the driving method of the plasma display used in the present invention are described in detail.

First Embodiment

Figure 1:
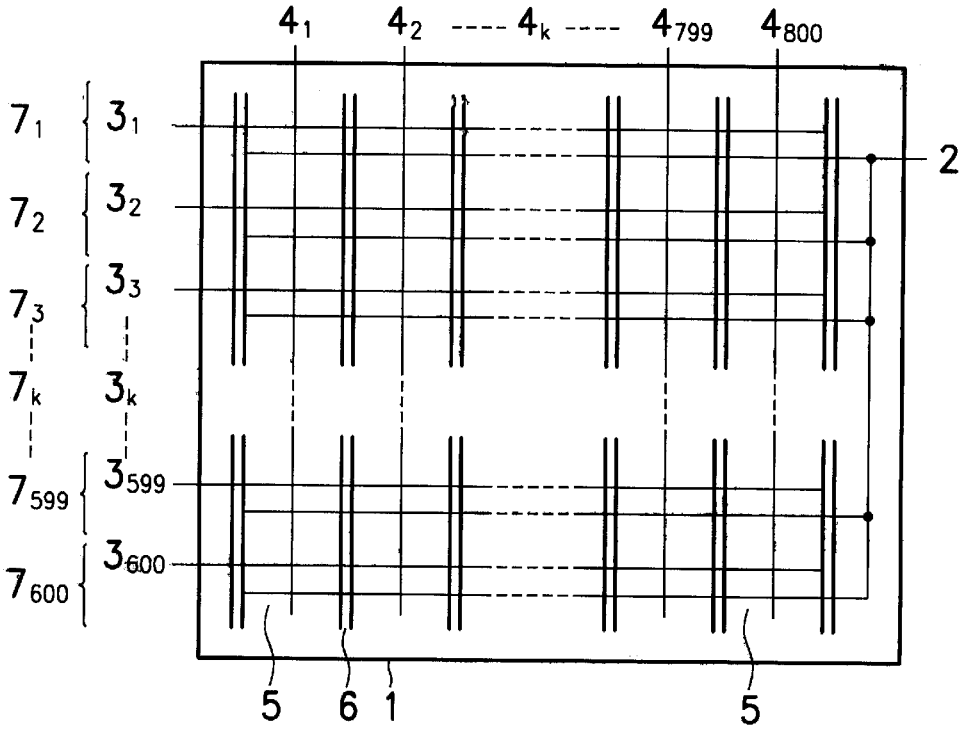
Fig. 1 (Prior Art)
FIG. 1 (Prior Art) is a top view of a three-electrode surface discharge plasma display.
Figure 2:
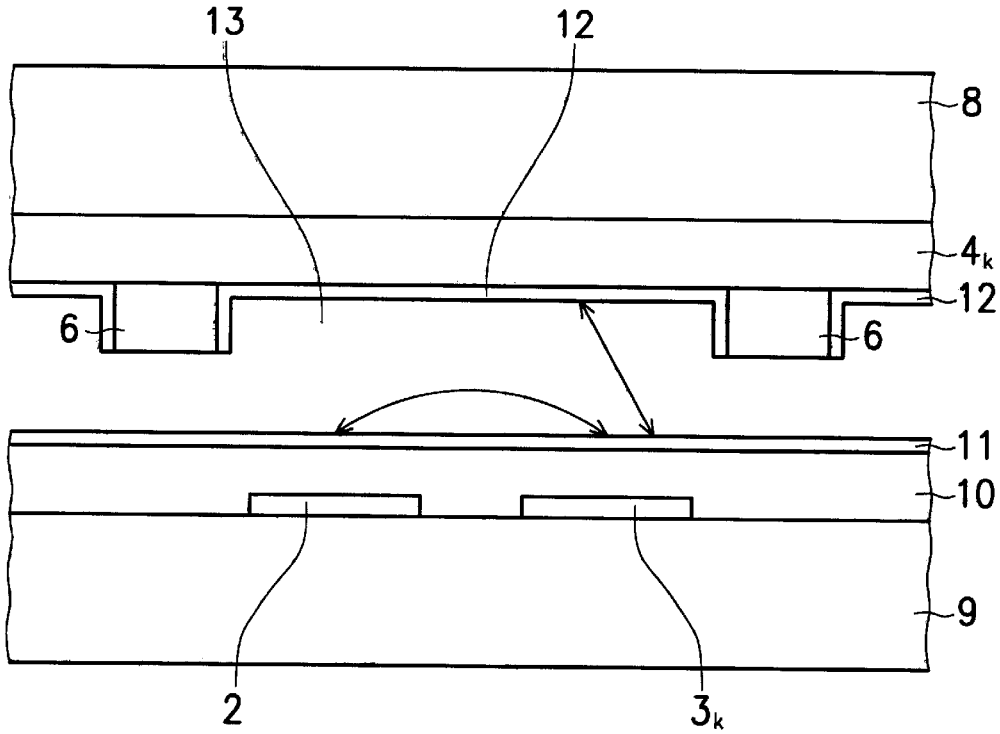
Fig. 2 (Prior Art)
FIG. 2 (Prior Art) is a schematic cross-sectional view of the picture pixel in the plasma display.
Figure 3:
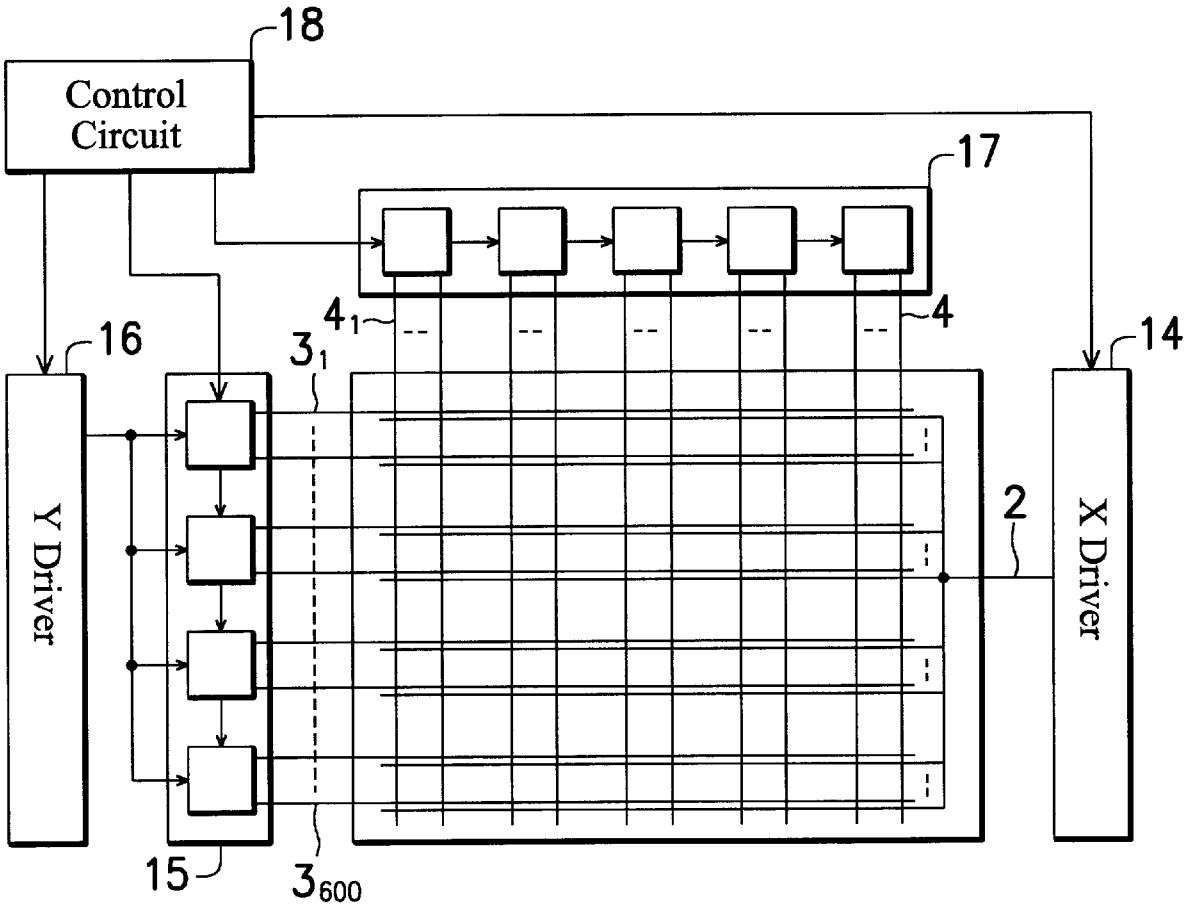
Fig. 3 (Prior Art)
FIG. 3 (Prior Art) is a circuit diagram showing the plasma screen and its peripheral circuitry.
Figure 4:
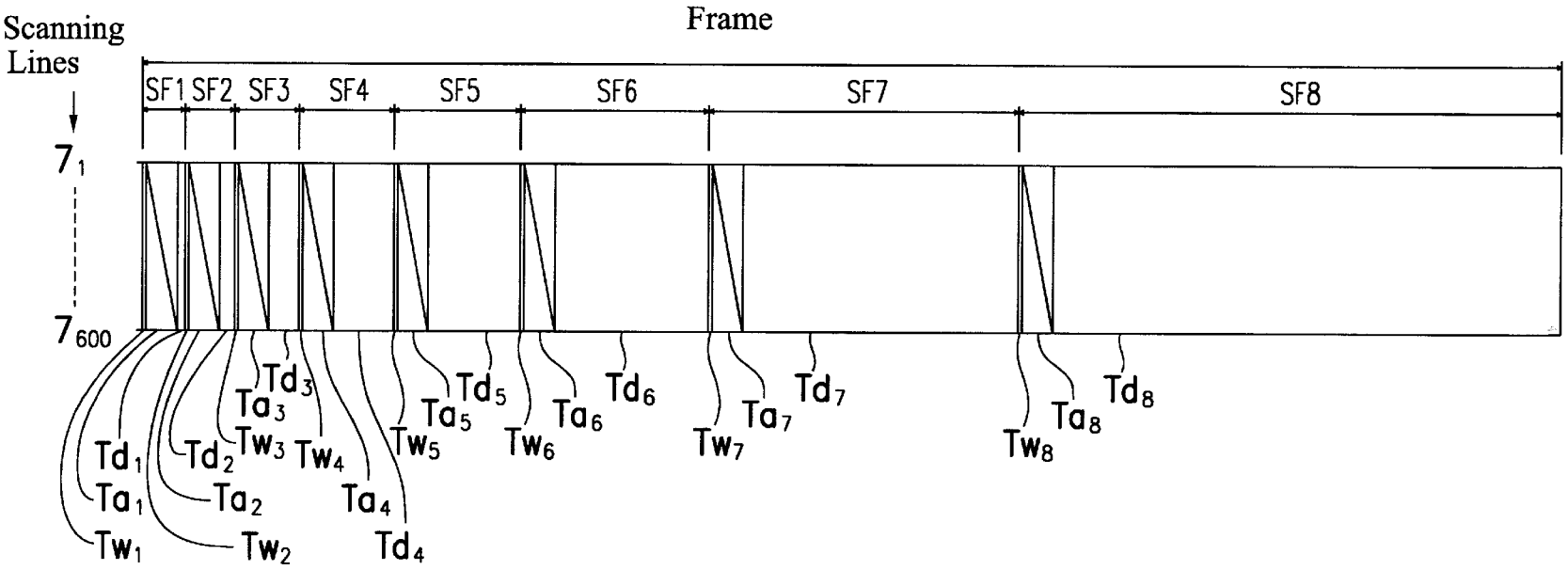
Fig. 4 (Prior Art)
FIG. 4 (Prior Art) is a schematic timing diagram for illustrating a full frame-display operation using the conventional driving technique.
Figure 5:
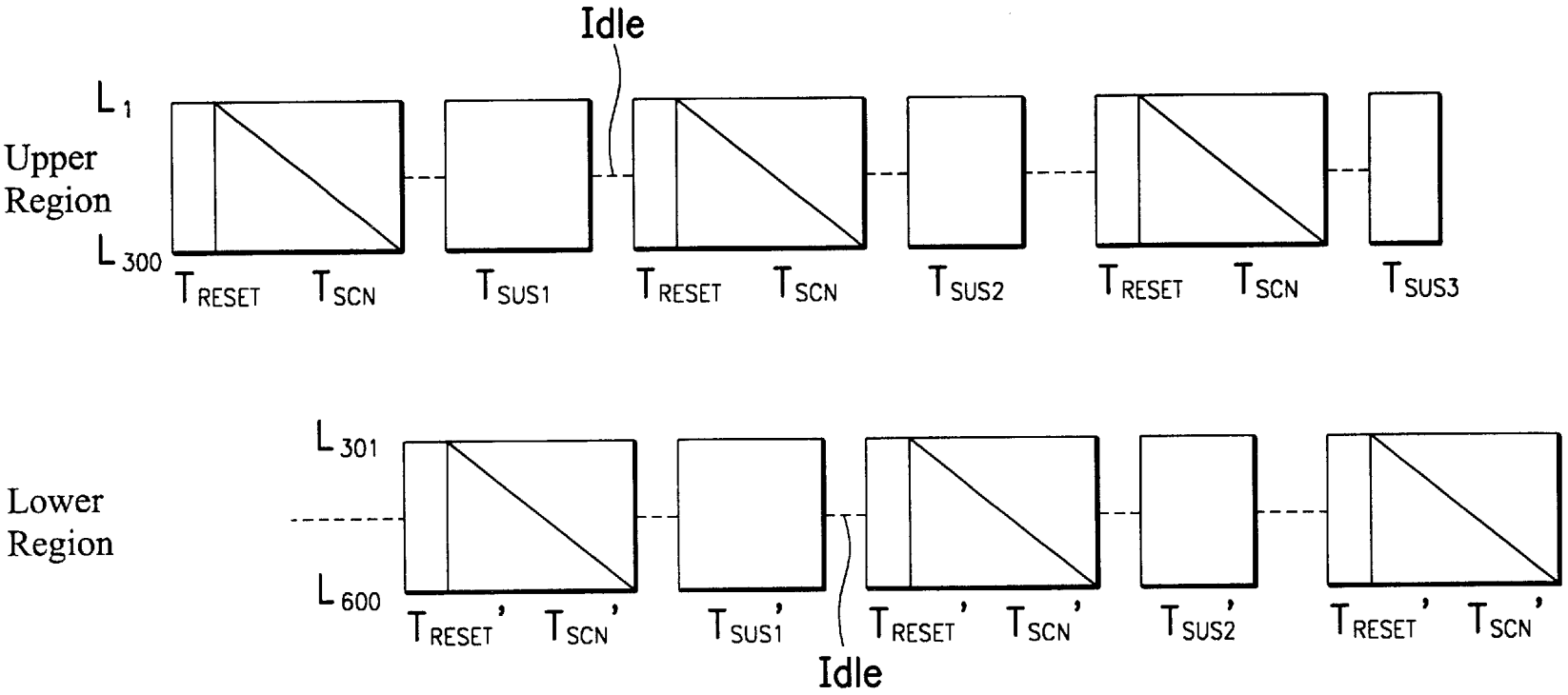
FIG. 5 is a schematic timing diagram pertaining to the driving process in the first embodiment of the present invention.

FIG. 5 is a schematic timing diagram pertaining to the driving process in the first embodiment. In this embodiment, the screen of the plasma display is divided into two sub-regions, including an upper region and a lower region. On each sub-region the three fundamental operations, including the reset operation, the scan operation and the sustain operation, are performed to complete the corresponding sub-frame operation. Suppose that the plasma display has a resolution of 800×600 pixels and 8-bit 256 gray scales, which means that a full frame-display operation includes eight sub-frame operations (one sub-frame corresponding to one bit). In addition, the upper region (scanning lines 1~300) and the lower region (scanning lines 301~600) contain 300 scanning lines, respectively. The period of each scan operation in each sub-frame corresponding to each sub-region, denoted by $T_{SCN}$ or $T_{SCN'}$, is the period of scanning 300 scanning lines, which is equivalent to half the time of scanning the whole screen of the plasma display (600 scanning lines). Therefore, if displaying each scanning line requires 3 $\mu$s, the period of each scan operation requires 300×3=900 $\mu$s. In addition, the periods of each reset operations in any sub-region, denoted by $T_{RESET}$, are the same as 100 $\mu$s.

Next, the driving method of the plasma display in this invention is described as follows.

As shown in FIG. 5, the reset operation and the scan operation for the first sub-frame of the upper region are sequentially performed. When the reset operation and the scan operation on the upper region have finished, the sustain operation (denoted by $T_{SUS1}$) for the first sub-frame of the upper region is not performed immediately and will be delayed for a while, thereby preventing signal interference with the reset operation of the lower region that is performed sequentially. Therefore, the sustain operation pertaining to the upper region first sub-frame is performed after the reset operation pertaining to the lower region first sub-frame has finished, but before the scan operation for the lower region first sub-frame has finished. Similarly, when the reset operation and the scan operation on the lower region have finished, the sustain operation (denoted by $T_{SUS1'}$) for the first sub-frame of the lower region is also not performed immediately and will be delayed for a while, thereby preventing signal interference with the reset operation of the second sub-frame of the upper region that is performed sequentially. In addition, the sustain operation pertaining to the lower region first sub-frame is performed after the reset operation pertaining to the upper region second sub-frame has started, but before the scan operation for the upper region second sub-frame has finished.

In the above description, the sustain operations on the upper region and the lower region will not waste extra time and can be performed simultaneously with the scan operations on the other sub-region. For example, displaying image data with 256 gray scales requires eight sub-frame operations. In this embodiment, the maximum time limit of the sustain operation for each sub-frame is 900 $\mu$s, which is the period to perform the scan operation for the upper region or the lower region (300 scanning lines). It is evident that using this driving method, the period of the sustain operation of the upper region sub-frame, which is proportional to the brightness level of the upper region, can be maximally extended to be the period of the scan operation of the lower region sub-frame. Therefore, the plasma display using higher resolutions can maintain the brightness level using this driving method.

In the embodiment, the ratio of the periods of the sustain operations in the eight sub-frame operations is defined as 1:2:4:8:16:32:64:128, as described in the conventional case. For example, if the longest sustaining period $T_{SUS1}$ is 600 $\mu$s, can be 300 $\mu$s and $T_{SUS3}$ can be 150 $\mu$s.

In this embodiment, the display screen is divided into the first sub-region (upper region), and the second sub-region (lower region). The sustain operation must satisfy the following conditions:

1. The sustain operation for the first sub-region sub-frame is started after the reset operation for the second sub-region sub-frame has finished, but before the scan operation for the second sub-region sub-frame has finished. Therefore, the period of the sustain operation for the first sub-region can be maximally extended to be the period of the scan operation for the second sub-region.

2. The sustain operation in the first sub-region cannot be coincident with the reset operation in the second sub-region, thereby preventing signal interference between both of the sub-regions. Therefore, when a reset operation is performed on the first sub-region, any operation in the second sub-regions is suspended.

Second Embodiment

Figure 6:
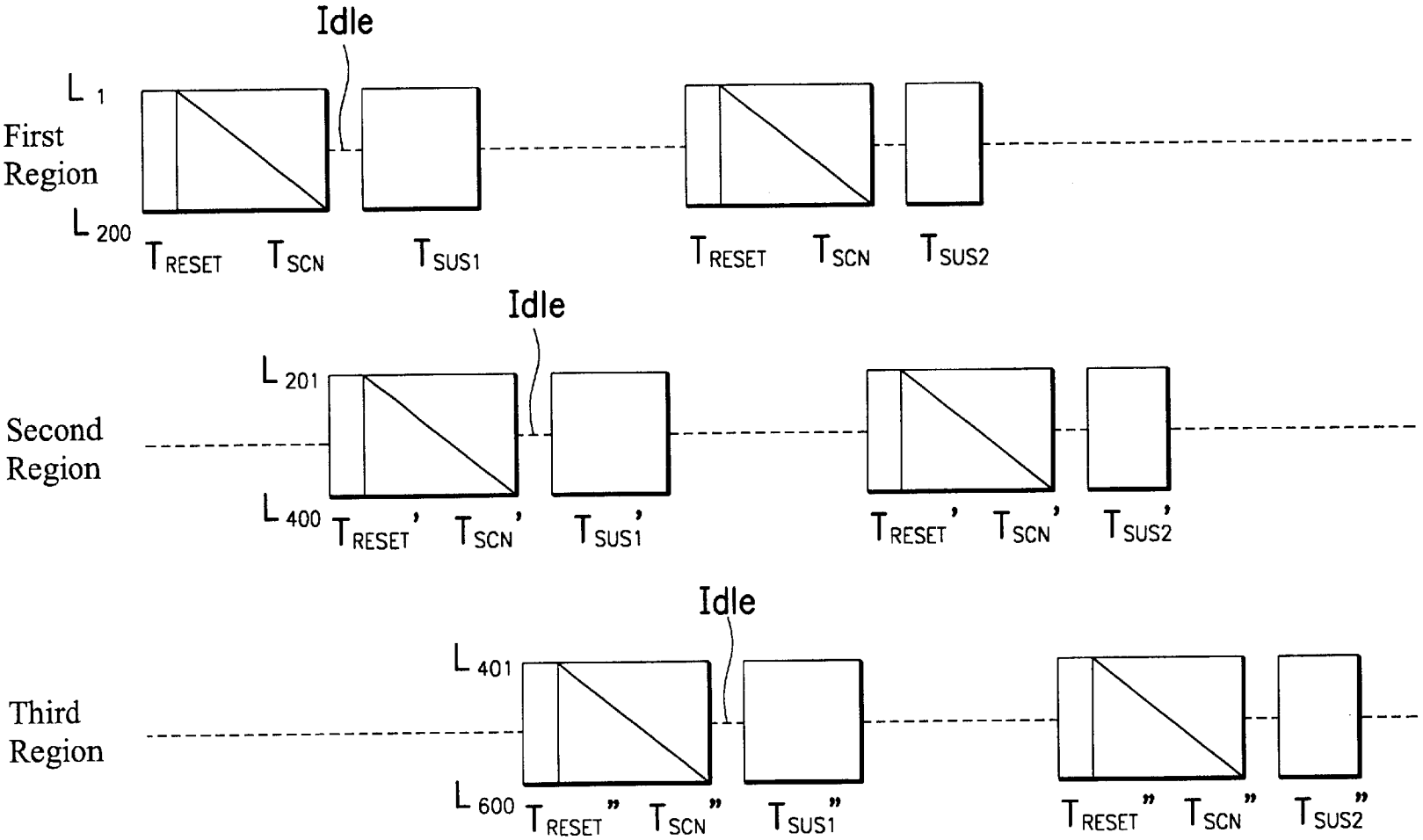
FIG. 6 is a schematic timing diagram pertaining to the driving process in the second embodiment of the present invention.

Different from the first embodiment, the second embodiment illustrates a case in which the screen of the plasma display is divided into three sub-regions FIG. 6 is a schematic timing diagram pertaining to the driving process in the second embodiment. In the plasma display with a resolution of 800×600 and 256 gray scales, the screen is divided into three sub-regions. As shown in FIG. 6, the first sub-region contains 200 scanning lines (scanning lines 1~200), denoted by $L_1$~$L_{200}$. The second sub-region contains 200 scanning lines, denoted by $L_{201}$~$L_{400}$ (scanning lines 201~400). The third sub-region also contains 200 scanning lines, denoted by $L_{401}$~$L_{600}$ (scanning lines 401~600). A sub-frame operation is executed by sequentially performing the reset operations, the scan operations and the sustain operations on the three sub-regions, respectively. The period of each scan operation in any sub-region, denoted by $T_{SCN}$, is the same as that of scanning 200 scanning lines, which is equal to one-third the time of scanning the whole screen of the plasma display (600 scanning lines). Therefore, if displaying each scanning line requires 3 $\mu$s, the period of each scan operation requires 200×3=600 $\mu$s. In addition, the periods of each reset operations in any sub-region, denoted by $T_{RESET}$ are the same as 90 $\mu$s.

Next, the driving method of the plasma display in this invention is described as follows.

As shown in FIG. 6, the reset operation and the scan operation for the first sub-frame of the first sub-region are sequentially performed. When the reset operation and the scan operation on the first sub-region have finished, the sustain operation (denoted by $T_{SUS1}$) for the first sub-frame of the first sub-region is not performed immediately and will be delayed for a period, thereby preventing signal interference with the reset operation of the sub-region that is subsequently processed. Therefore, the sustain operation pertaining to the first sub-region first sub-frame is started after the reset operation pertaining to the second sub-region first sub-frame has finished, but before the scan operation for the second sub-region first sub-frame has finished. Therefore, the sustain operation pertaining to the first sub-region is synchronized with the scan operation pertaining to the second sub-region.

Similarly, when the reset operation and the scan operation on the second sub-region have finished, the sustain operation for the first sub-frame of the second sub-region is also not performed immediately and will be delayed for a period, thereby preventing signal interference with the reset operation of the first sub-frame of the third sub-region that is subsequently processed. In addition, the sustain operation pertaining to the second sub-region first sub-frame is started after the reset operation pertaining to the third sub-region first sub-frame has finished, but before the scan operation for the third sub-region first sub-frame has finished.

After the reset operation and the scan operation on the third sub-region have finished, the sustain operation in the same sub-region is also delay for a period to prevent signal interference with the reset operation of the second sub-frame of the first sub-region that is subsequently processed. It means that the sustain operation pertaining to the third sub-region first sub-frame is started after the reset operation pertaining to the first sub-region second sub-frame has finished, but before the scan operation for the first sub-region second sub-frame has finished.

Reset operations, scan operations and sustain operations performed on the subsequent sub-frames are similar to those described above and will not be further discussed. It is noted that the sustain operations in these three sub-regions do not require extra time and can be performed simultaneously with the scan operations of the subsequent sub-regions. Therefore, the period of the sustain operation can be maximally extended to be the period of the scan operation, thereby improving the brightness level of the plasma display.

According to the above embodiments, the method of driving a plasma display can be summarized as follows:

(1) The screen of the plasma display is divided into several non-overlapping sub-regions, which can be independently driven.

(2) The sustain operation on one of the sub-regions is started after the reset operation of the next sub-region that is subsequently processed. Accordingly, the working period of the sustain operation, which is proportional to the brightness level of the plasma display, can be maximally extended to the period of the scan operation of next region.

(3) The reset operation on one of the sub-regions cannot coincident with any operations on other sub-regions, thereby preventing signal interference between different sub-region of the plasma screen.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of driving a plasma display, in which a frame is displayed by sequentially performing a reset operation, a scan operation and a sustain operation, comprising the steps of:

dividing a screen of the plasma display into at least a first sub-region and a second sub-region;

sequentially performing the reset operation, the scan operation and the sustain operation on both the first sub-region and the second sub-region;

wherein the sustain operation on the first sub-region is started after the reset operation of the second sub-region that is subsequently processed and the reset operation on the first sub-region does not coincide with the reset operation, the scan operation, and the sustain operation on the second sub-region.

2. The method as recited in claim 1, wherein the screen of the plasma display is divided into a first sub-region and a second sub-region.

3. The method as recited in claim 2, wherein the sustain operation on the first sub-region is synchronized with the scan operation on the second sub-region and the sustain operation on the second sub-region is synchronized with the scan operation on the first sub-region.

4. The method as recited in claim 2, wherein the reset operation or the first sub-region is followed by the scan operation on the second sub-region and does not overlap the scan operation and the sustain operation on the second sub-region.

5. The method as recited in claim 2, wherein the reset operation on the second sub-region is followed by the scan operation on the first sub-region and does not overlap the scan operation and the sustain operation on the first first-region.

6. A method of driving a plasma display, comprising the steps of:

dividing a screen of the plasma display into a first sub-region and a second sub-region;

resetting the first sub-region of the screen of the plasma display and halting the driving of the second sub-region;

simultaneously scanning the first sub-region and sustaining the second sub-region;

resetting the second sub-region of the screen of the plasma display and halting the driving of the first sub-region; and simultaneously sustaining the first sub-region and scanning the second sub-region.

7. The method as recited in claim 6, wherein the first sub-region and the second sub-region are non-overlapped, the first sub-region is an upper region of the screen of the plasma display and the second sub-region is a lower region of the screen of the plasma display.

8. The method as recited in claim 6, wherein the plasma display has 256 gray scales.

9. A method of driving a plasma display, in which a frame is displayed by sequentially performing a reset operation, a scan operation and a sustain operation, comprising the steps of:

dividing a screen of the plasma monitor into a plurality of sub-regions;

sequentially performing the reset operation, the scan operation and the sustain operation on the sub-regions, wherein the sustain operation on one of the sub-regions is synchronized with the scan operation of another one of the sub-regions that is subsequently processed and the reset operation on one of the sub-regions does not overlap the scan operations and the sustain operations on other sub-regions.

10. The method as recited in claim 9, wherein the screen of the plasma display is divided into a first sub-region and a second sub-region.

11. The method as recited in claim 10, wherein the sustain operation on the first sub-region is synchronized with the scan operation on the second sub-region and the sustain operation on the second sub-region is synchronized with the scan operation on the first sub-region.

12. The method as recited in claim 10, wherein the reset operation on the first sub-region is followed by the scan operation on the second sub-region and does not overlap the scan operation and the sustain operation on the second sub-region.

13. The method as recited in claim 10, wherein the reset operation on the second sub-region followed by the scan operation on the first sub-region and does not overlap the scan operation and the sustain operation on first first-region.

14. The method as recited in claim 1, for increasing working period of the sustain operation, thereby improving brightness level and resolution limitation of the plasma display.

15. The method as recited in claim 6, for increasing working period of the sustain operation, thereby improving brightness level and resolution limitation of the plasma display.

16. The method as recited in claim 9, for increasing working period of the sustain operation, thereby improving brightness level and resolution limitation of the plasma display.

* * * * *